US007213300B1

(12) United States Patent
Domenig et al.

(10) Patent No.: US 7,213,300 B1
(45) Date of Patent: May 8, 2007

(54) FULL OVERLAY HINGE WITH THREE-DIMENSIONAL MECHANICAL ADJUSTMENT AND SIDE PINS

(75) Inventors: Georg Domenig, Kernersville, NC (US); Jeffery W. Morgan, High Point, NC (US)

(73) Assignee: Grass America Inc., Kernersville, NC (US)

( * ) Notice: Subject to any disclaimer, the term of this patent is extended or adjusted under 35 U.S.C. 154(b) by 154 days.

(21) Appl. No.: 11/065,729

(22) Filed: Feb. 25, 2005

(51) Int. Cl.
*E05D 7/04* (2006.01)
*E05D 7/06* (2006.01)

(52) U.S. Cl. ..... 16/236

(58) Field of Classification Search ..... 16/235, 16/236, 238, 242, 254, 258, 240, 246, 382, 16/351, 265, 271, DIG. 43; 403/322.4
See application file for complete search history.

(56) References Cited

U.S. PATENT DOCUMENTS

| | | | | |
|---|---|---|---|---|
| 4,701,979 | A * | 10/1987 | Salice | 16/346 |
| 4,716,622 | A | 1/1988 | DeBruyn | |
| 5,210,907 | A * | 5/1993 | Toyama | 16/258 |
| 5,295,282 | A | 3/1994 | Lautenschlager | |
| 5,392,493 | A | 2/1995 | Youngdale | |
| 5,511,287 | A | 4/1996 | Lautenschlager et al. | |
| 5,621,947 | A * | 4/1997 | Fitz et al. | 16/249 |
| 6,032,333 | A * | 3/2000 | Brustle | 16/242 |
| 6,088,879 | A * | 7/2000 | Gasser | 16/257 |
| 6,148,479 | A * | 11/2000 | Lin | 16/258 |
| 6,240,599 | B1 | 6/2001 | Peer et al. | |
| 6,266,848 | B1 * | 7/2001 | Fraccaro et al. | 16/245 |
| 6,615,452 | B2 * | 9/2003 | Mueller et al. | 16/242 |
| 6,643,895 | B1 * | 11/2003 | Domenig et al. | 16/238 |
| 6,647,591 | B1 * | 11/2003 | Domenig et al. | 16/242 |
| 6,845,544 | B2 * | 1/2005 | Hofer | 16/246 |
| 6,880,205 | B2 * | 4/2005 | Rupprechter | 16/235 |
| 6,901,633 | B2 * | 6/2005 | Chen | 16/240 |
| 6,918,158 | B2 * | 7/2005 | Isele | 16/235 |
| 7,017,231 | B2 * | 3/2006 | Isele | 16/242 |
| 2004/0163211 | A1 * | 8/2004 | Rucker | 16/235 |

FOREIGN PATENT DOCUMENTS

| | | | |
|---|---|---|---|
| EP | 453829 | A1 * | 10/1991 |
| JP | 03172476 | A * | 7/1991 |
| JP | 03172477 | A * | 7/1991 |

* cited by examiner

*Primary Examiner*—Robert J. Sandy
*Assistant Examiner*—Andre' L. Jackson
(74) *Attorney, Agent, or Firm*—Kilpatrick Stockton LLP; John M. Harrington

(57) ABSTRACT

Hinge assembly for mounting a door on a furniture frame for movement of the door between open and closed positions of the door relative to the furniture frame comprising a mounting plate adapted to be affixed to a furniture frame member, an intermediate plate disposed atop of and slideably engaged to said mounting plate, a top plate disposed atop of and slideably engaged to said intermediate plate and said mounting plate, a hinge arm slideably connected to said top plate, and a pin extending through a portion of said top plate, slideably extending through a portion of said intermediate plate such that said intermediate plate is slideable in a first direction along the axis of the pin, and slideably extending through a portion of said mounting plate such that said pin is slideable in a second direction perpendicular to the axis of the pin relative to the mounting plate. Further, the hinge assembly is adjustable such that the hinge arm can be adjusted in three dimensions relative to the mounting plate.

9 Claims, 3 Drawing Sheets

FULL OVERLAY HINGE WITH THREE-DIMENSIONAL MECHANICAL ADJUSTMENT AND SIDE PINS

FIELD OF THE INVENTION

The present invention relates generally to hinge devices for mounting a door on a furniture article, and more particularly to adjustable hinge devices for hanging doors on cabinets or the like so that the doors can be adjusted relative to the supporting frame they are attached to.

BACKGROUND OF THE INVENTION

Various types of hinges for mounting a door on a furniture article such as a desk or cabinet have been used in the furniture and cabinetry industry for many years. An example of one such device is known from U.S. Pat. No. 4,716,622. Many of such devices include multiple adjustment components making them bulky, difficult to adjust, quick to wear, and unstable. Typically, one or more screws must be loosened, an adjustment made manually, and then one or more screws must be re-tightened to secure the adjustment. Accordingly, many adjustable hinges may require more than one person to accomplish the adjustment. Examples of such hinges include those described in U.S. Pat. Nos. 5,295,282, 5,392,493, and 5,511,287. Improvements to these hinges have been made, such as those depicted in U.S. Pat. No. 6,240,599, so that adjustments can be made quickly and easily by one person. However, further improvements are still needed so that hinges can be adjusted with greater efficiency and more precise reliability. To do this, it has been determined that more refined design engineering is required, and the present invention addresses this need and interest.

Three-dimensionally adjustable hinges of the prior art generally encompass one of two forms. In one such prior art design, the height adjustment of the door is accomplished by loosening the mounting screw or screws which extend into the wood furniture frame, adjusting the hinge vertically, then tightening the wood screws to secure the hinge in position. This is a cumbersome method of adjusting the hinge and often leads to deterioration of the wood and eventual failure of the hinge to support the weight of the door. In another prior art hinge design, a series of adjustment screws are provided; however, they are not capable of independent interaction. The adjustment of one screw necessarily requires adjustment of a second screw. This is due, primarily, to simplify the design of such a hinge. It would, therefore, be desirable to provide a hinge with three-dimensional mechanical adjustment means which are independent of one another and do not require adjustment of the mounting screw.

The mechanics of adjustable hinge components require various hinge plates to slide upon one another. The hinge components require small tolerances between them so as to minimize play between the components and to securely retain a furniture door in place. Further, the hinge components must support the weight of the door and the stresses associated with opening and closing during operation. As the door moves between an open and a closed position, the forces acting on the various components of the hinge mounting assembly can change dramatically. This has the potential to adversely affect the components and cause excess wear or damage. The additional components required for three dimensional adjustment must be precisely designed so as to tolerate these stresses, but not interfere with the mechanics of the hinge.

SUMMARY OF THE INVENTION

In a first aspect of the present invention, a hinge assembly for mounting a door on a furniture frame for movement of the door between open and closed positions of the door relative to the furniture frame is provided comprising a mounting plate adapted to be affixed to a furniture frame member, an intermediate plate disposed atop of and slideably engaged to said mounting plate, a top plate disposed atop of and slideably engaged to said intermediate plate and said mounting plate, a hinge arm slideably connected to said top plate, and a pin extending through a portion of said top plate, slideably extending through a portion of said intermediate plate such that said intermediate plate is slideable in a first direction along the axis of the pin, and slideably extending through a portion of said mounting plate such that said pin is slideable in a second direction perpendicular to the axis of the pin relative to the mounting plate. Further, the hinge assembly is adjustable such that the hinge arm can be adjusted in three dimensions relative to the mounting plate.

In another embodiment of the present invention, the mounting plate comprises a body portion having an elongated mounting aperture, a front end, a rear end and two side ends, and said side ends each have a side member extending at a right angle from said body portion, the side members each comprising an elongated aperture for receiving said pin. In a further embodiment of the present invention, the mounting plate further comprises a leg depending from said front end and said rear end in a direction opposite said side members, said legs positioned and aligned to engage and secure said mounting plate to said furniture frame.

In an additional embodiment of the present invention, the intermediate plate comprises a body portion having two side flanges extending from either side thereof, said side flanges extending vertically from said body portion and each having a horizontally extending portion, said vertically extending portion having an aperture therein for receiving said pin. In a still additional embodiment of the present invention, the intermediate plate further comprises a hook member extending from said body portion for slideably engaging said pin between the two side flanges.

In yet another embodiment of the present invention, the top plate comprises a body portion, a front face extending downward from said body portion, and two side members extending from either side of said body portion, said side members each having an aperture for receiving said pin, and said front face adapted to slideably engage said hinge arm.

In a further embodiment of the present invention, the hinge assembly further comprises a second pin extending through a second aperture in said side members of the top plate, a second elongated aperture in said mounting plate side members, and a second aperture in said intermediate plate side flange, wherein said first pin is positioned proximate to the front of said hinge assembly and said second pin is positioned proximate to the rear of said hinge assembly.

In another embodiment of the present invention, the hinge assembly further comprising a hinge cup member adapted to be affixed to a door and pivotably connected to the hinge arm. Additionally, a front cam screw is provided extending through an elongated aperture on said hinge arm segment, and a circular aperture on the front face of said top plate, such that by rotating the front cam screw, the hinge arm slides up and down on the face of the L-shaped hinge arm segment thereby moving the hinge cup and furniture door from side to side relative to said furniture frame.

An additional embodiment of the present invention further comprises a side cam screw positioned proximate to one side of the top surface of the top plate and extending through an elongated aperture in said top surface, and through a circular aperture in the horizontally extending portion of the intermediate plate, such that by rotating the side cam screw the L-shaped hinge arm segment slides from side to side relative to the intermediate plate and the mounting plate, said pin moving with said top plate, thereby moving said furniture door up and down relative to said furniture frame.

Yet another embodiment of the present invention further comprises a rear cam screw positioned proximate a rear portion of the hinge assembly and extending through an elongated aperture in said rear portion of the intermediate plate and into a circular aperture in said rear portion of said mounting plate, such that by rotating the rear cam screw, the intermediate plate slides front to rear relative to the base plate, said pin and said top plate moving with said intermediate plate, thereby causing the furniture door to move in and out relative to the furniture frame.

It is a feature and advantage of the present invention to provide a hinge with three-dimensional mechanical adjustment means which are independent of one another and do not require adjustment of the mounting screw.

Features of a hinge assembly of the present invention may be accomplished singularly, or in combination, in one or more of the embodiments of the present invention. As will be appreciated by those of ordinary skill in the art, the present invention has wide utility in a number of applications as illustrated by the variety of features and advantages discussed below.

As will be realized by those of skill in the art, many different embodiments of a hinge assembly according to the present invention are possible. Additional uses, objects, advantages, and novel features of the invention are set forth in the detailed description that follows and will become more apparent to those skilled in the art upon examination of the following or by practice of the invention.

Thus, there has been outlined, rather broadly, the more important features of the invention in order that the detailed description that follows may be better understood and in order that the present contribution to the art may be better appreciated. There are, obviously, additional features of the invention that will be described hereinafter and which will form the subject matter of the claims appended hereto. In this respect, before explaining several embodiments of the invention in detail, it is to be understood that the invention is not limited in its application to the details and construction and to the arrangement of the components set forth in the following description or illustrated in the drawings. The invention is capable of other embodiments and of being practiced and carried out in various ways.

It is also to be understood that the phraseology and terminology herein are for the purposes of description and should not be regarded as limiting in any respect. Those skilled in the art will appreciate the concepts upon which this disclosure is based and that it may readily be utilized as the basis for designating other structures, methods and systems for carrying out the several purposes of this development. It is important that the claims be regarded as including such equivalent constructions insofar as they do not depart from the spirit and scope of the present invention.

So that the manner in which the above-recited features, advantages and objects of the invention, as well as others which will become more apparent, are obtained and can be understood in detail, a more particular description of the invention briefly summarized above may be had by reference to the embodiment thereof which is illustrated in the appended drawings, which drawings form a part of the specification and wherein like characters of reference designate like parts throughout the several views. It is to be noted, however, that the appended drawings illustrate only preferred and alternative embodiments of the invention and are, therefore, not to be considered limiting of its scope, as the invention may admit to additional equally effective embodiments.

DETAILED DESCRIPTION

Figure 1:
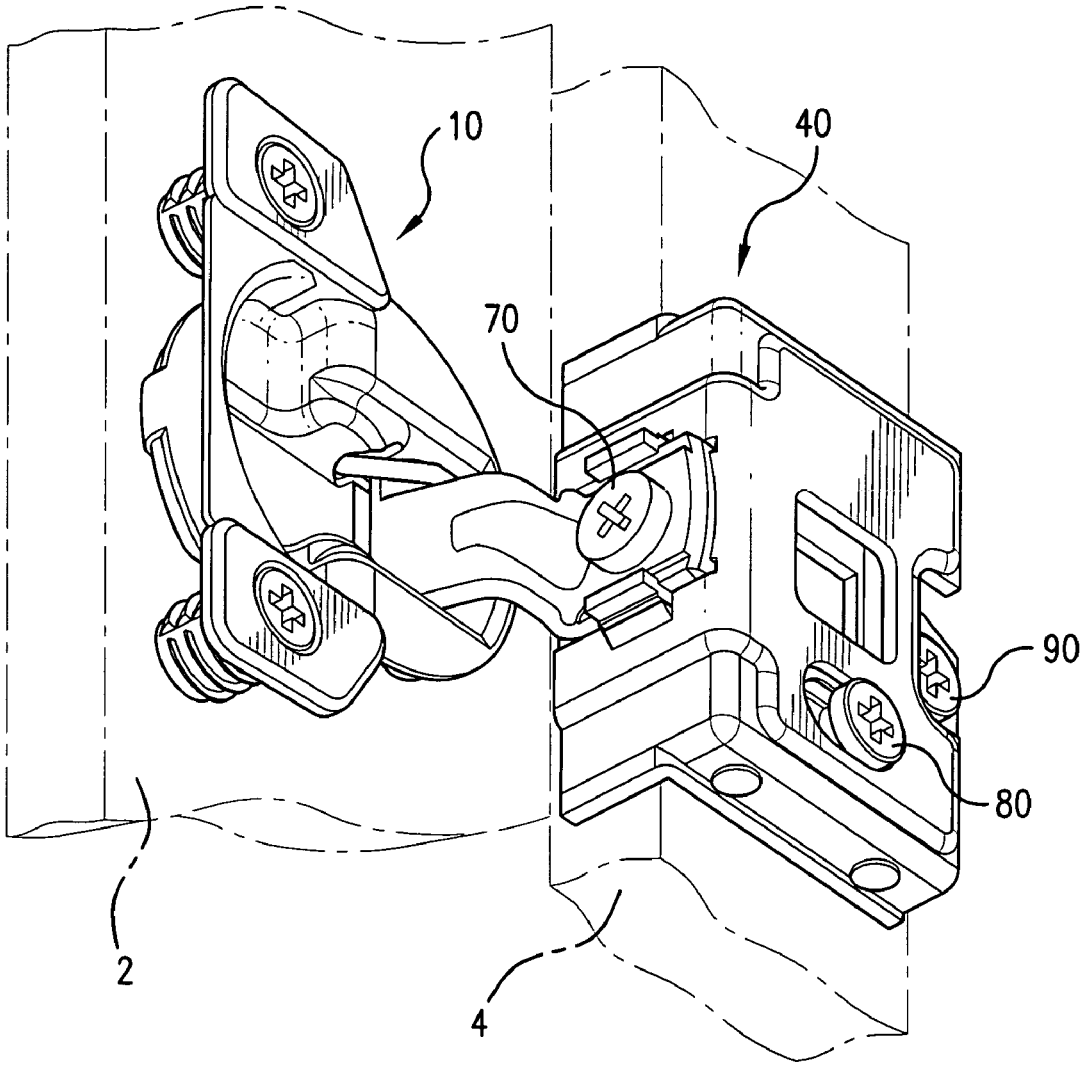
FIG. 1 is a top perspective view of a hinge assembly in an embodiment of the present invention.
Figure 2:
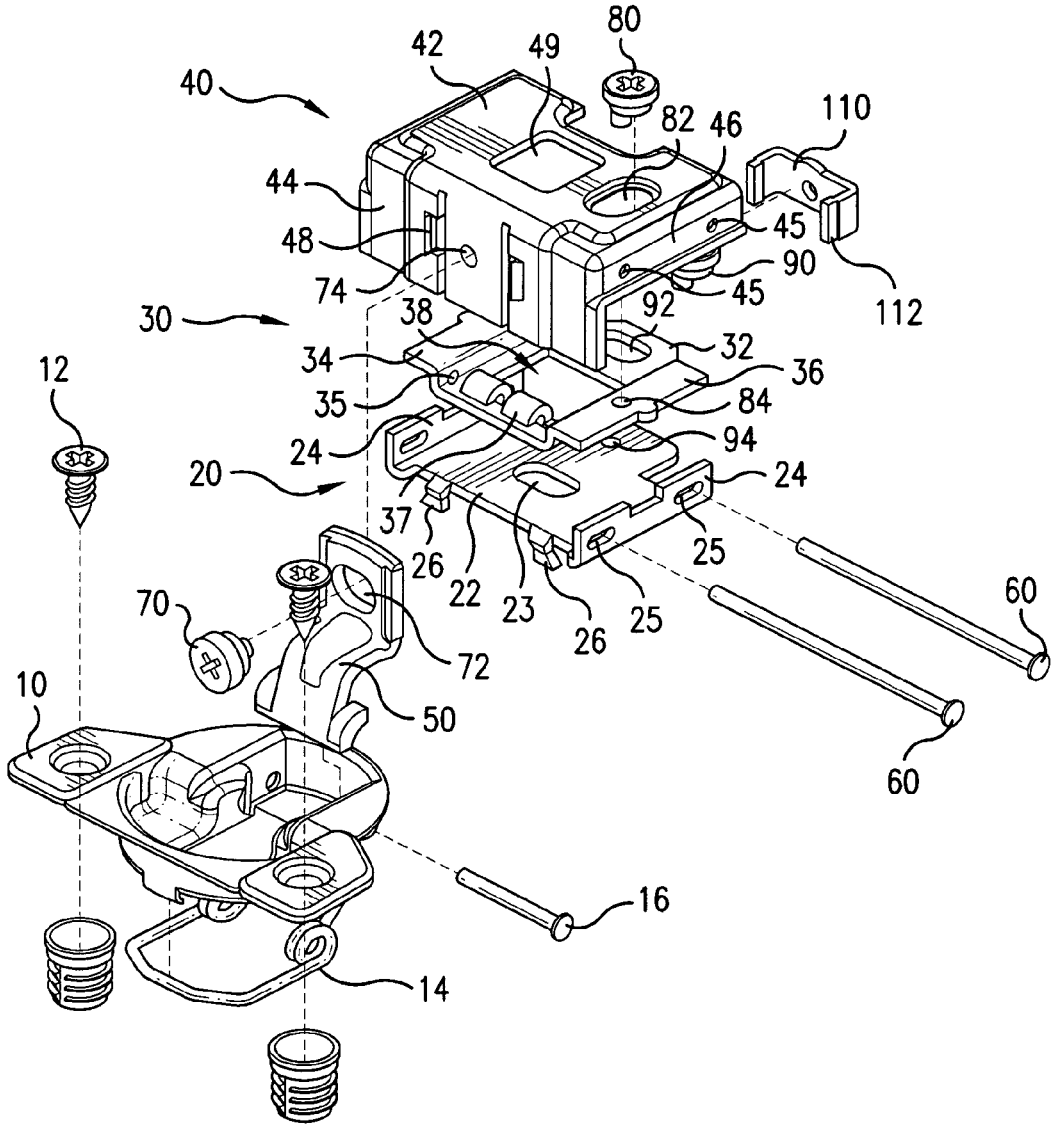
FIG. 2 is a front perspective exploded view of a hinge assembly in an embodiment of the present invention.
Figure 3:
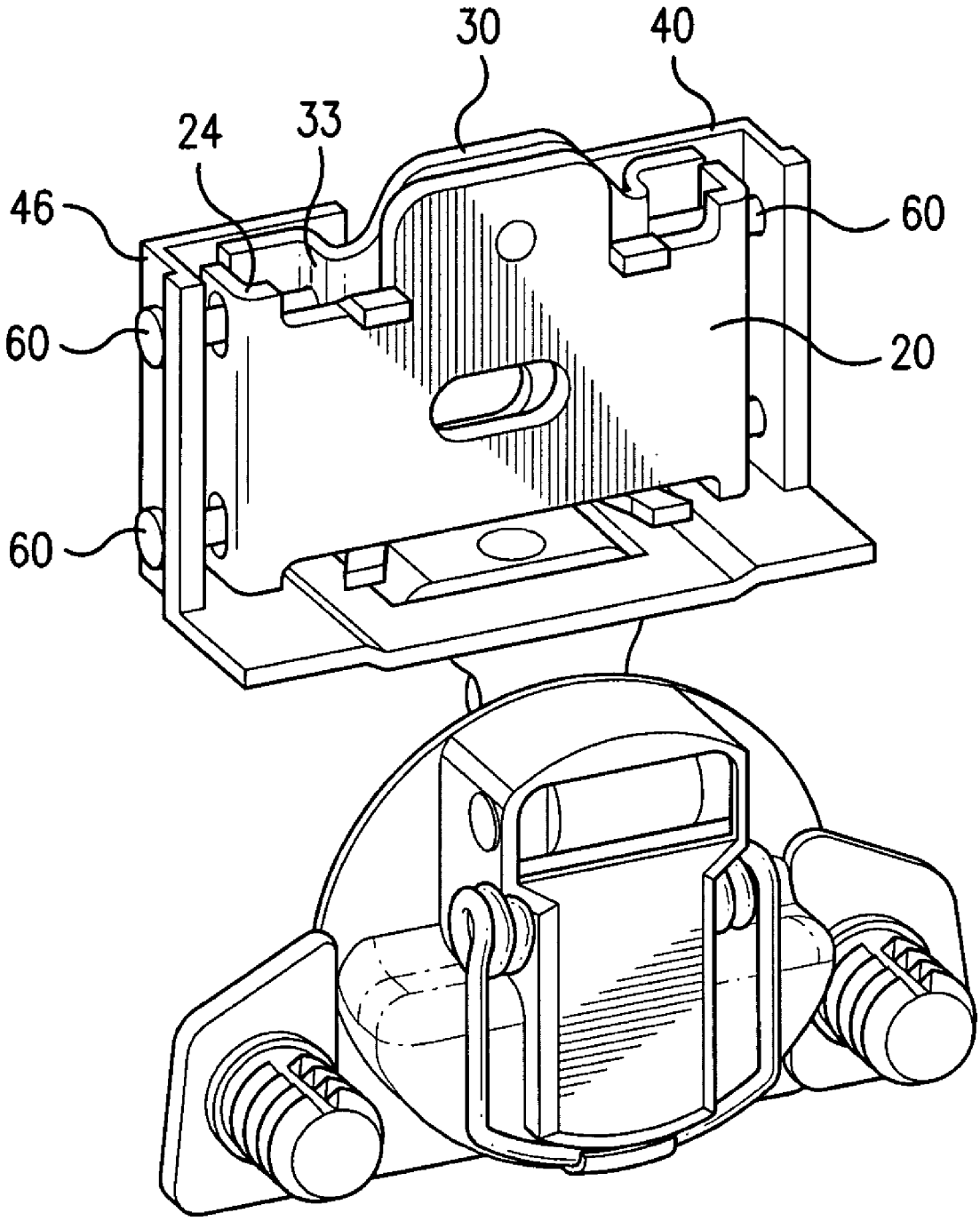
FIG. 3 is a bottom view of a hinge assembly in an embodiment of the present invention.

For the purposes of promoting an understanding of the invention, reference will now be made to some preferred embodiments of the present invention as illustrated in FIGS. 1–3, and specific language used to describe the same. Numerous specific details are set forth below in order to provide a thorough understanding of the present invention. However, it will be obvious to one skilled in the art that the present invention may be practiced without some or all of these specific details. Therefore, it should be understood that no limitation of the scope of the invention is hereby intended. The terminology used herein is for the purpose of description, not limitation. Any modifications or variations in the depicted hinges, and such further applications of the principles of the invention as illustrated herein, as would normally occur to one skilled in the art, are considered to be within the spirit of this invention.

During the description of the many embodiments of the present invention, directional orientation will be used to distinguish among the three degrees of adjustment of the hinge assembly. For the purposes of this discussion, reference will be made to a hinge prior to installation wherein "front" refers to the portion of the hinge assembly closest to the hinge cup, which when installed, will be closest to the furniture door, with "rear" referring to the portion of the hinge assembly farthest from the hinge cup and that which will be facing the rear of the furniture cabinet when installed. The "bottom" of the hinge assembly is that which will be closest to the furniture frame when installed, with "top" being the opposite direction. These parameters are meant to be used for descriptive purposes only and as one skilled in the art will recognize, the hinge assembly may be mounted in an article of furniture in any orientation.

Referring now to FIGS. 1–3, there is shown various views of one embodiment of a three-dimensionally mechanically adjustable hinge assembly of the present invention wherein the three mechanical adjustment means are independent of one another. Hinges of the present invention may be used to hang a door 2 to the frame 4 of a furniture article, such as a cabinet. FIG. 1 shows a top perspective view of a hinge assembly in an open position (as it would appear when the cabinet door is open) with the door 2 and the furniture frame 4 illustrated in broken lines. FIG. 2 shows a top perspective exploded view of a hinge assembly in an embodiment of the present invention so that all the individual parts of hinge assembly can be more readily seen and understood. FIG. 3 shows a bottom view of the hinge assembly.

In a first aspect of the present invention, the hinge assembly is based on a five-part hinge assembly comprising a hinge cup 10, pivotably connected to a hinge arm segment 50 which is in turn slideably connected to an L-shaped top hinge plate 40, which in turn is slideably engaged to an intermediate plate 30, the combination of which is slideably engaged to a mounting plate 20. The mounting plate 20 is secured to a furniture frame member and the hinge cup 10 is secured to a furniture door 2.

The hinge cup 10 is mountable flush in a bore hole in the back of a door 2 with fastening screws 12 in a known manner, and includes a spring 14 so as to facilitate automatic closing of a door once the hinge has been partially closed. The hinge cup 10 is pivotably connected to the hinge arm 50 with a pin 16 which extends through apertures in the rear of the hinge cup 10 and provides a rotational surface for the end of the hinge arm to engage as is known in the art. Other hinge arm designs may also be used with the present invention, for example the hinge arm 50 may be incorporated into and form a part of the top plate 40, though this limits the adjustability of the hinge arm relative to said top plate.

In a preferred embodiment of the present invention, the distal end of the hinge arm 50 comprises an aperture 72 for receiving a cam screw 70 and abuts a front face of the top plate 40. A circular aperture 74 is provided in the front face 44 of top plate 40 for receiving the off center rod of the cam screw 70. As the screw is rotated, the off center rod spins within the circular aperture 74 causing the top of the cam screw 70 to spin on an eccentric axis within the elongated aperture 72, which in turn causes the hinge arm 50 to move up and down with respect to the stationary top plate 40. In this manner, the hinge arm 50, hinge cup 10, and furniture door 2 may be adjusted in and out relative to the furniture frame.

Mounted to the furniture frame member 4 are the mounting plate 20, intermediate plate 30, and top plate 40. The mounting plate 20 comprises a substantially flat body portion 22 having a front end, a rear end, and two sides. In a preferred embodiment of the present invention, the mounting plate is provided with a mounting aperture 23 for accepting a mounting screw which secures the mounting plate 20 to the furniture frame member 4. In a most preferred embodiment of the present invention, the mounting aperture 23 is positioned proximate to the center of the body portion 22 and is elongated in a direction parallel to the front and rear ends to allow adjustment of the mounting plate relative to the furniture frame member.

The two sides of the mounting plate 20 are provided with side members 24 extending vertically toward the top of the hinge assembly from the body portion 22. The side members each comprise at least one elongated aperture 25 for receiving a guide pin 60. The aperture 25 is elongated in a direction parallel to the length of the side member 24. In a preferred embodiment of the present invention, the side members 24 are each provided with two elongated apertures 25 for receiving two side pins 60. In this embodiment of the present invention, one set of elongated apertures is positioned proximate to the front end of the mounting plate, and the other pair of elongated apertures is positioned proximate to the rear end of the mounting plate 20.

In a further embodiment of the present invention, the body portion 22 is further provided with a circular aperture 94 for receiving the off center rod of a cam screw. This circular aperture 94 is preferably located toward the rear of the body portion 22 and central to the two side members 24. In another preferred embodiment of the present invention, the mounting plate further comprises legs 26 depending from the body portion 22 along a front end and a rear end. The legs 26 engage the sides of the furniture frame member 4 and assist in retaining the hinge assembly in position with respect to the frame member 4. In an alternate embodiment of the present invention, one leg 26 is provided extending across substantially each of the front and the rear of the body portion 22 of the mounting plate 20.

The intermediate plate 30 is slideably engaged to the mounting plate 20 such that it is free to move front to rear relative to the fixed mounting plate 20. The intermediate plate 30 comprises a substantially flat body portion 32 having two side flanges 34 on either side thereof and a front end and a rear end. A central aperture 38 is preferably provided to allow access, through the intermediate plate 30, to the mounting screw engaging the mounting plate 20. The side flanges 34 extend vertically from the body portion 32, then extend horizontally such that each flange comprises a vertically extending portion 33 and a horizontally extending portion 36. Apertures 35 are provided on the vertically extending portion 33 and are aligned with the elongated apertures 25 in the mounting plate 20 for receiving the guide pin (or pins) 60. In a preferred embodiment of the present invention, the apertures 35 in the intermediate plate are circular.

In a preferred embodiment of the present invention, the side flanges 34 of the intermediate plate 30 are preferably spaced closer to each other than the side members 24 of the mounting plate 20. In this manner, the intermediate hinge plate 30 fits within and is retained in a lateral direction by the side members 24 of the mounting plate 20.

When engaged to the mounting plate 20 with the pins 60, the intermediate plate 30 is free to slide from front to rear relative to the mounting plate 20 by sliding, along with the pins, through the range of motion provided by the elongated apertures 25 in the side members 24 of the mounting plate 20. In a preferred embodiment of the present invention, the intermediate plate 30 is provided with a hook member 37 which extends from the body portion 32 of the intermediate plate 30 and wraps around the pin 60, thereby providing additional support and contact between the front pin 60 and the intermediate plate 30.

In an alternate embodiment of the present invention, the configuration of the apertures for receiving the side guide pin 60 on the mounting plate 20 and intermediate plate 30 are reversed. In this embodiment, the apertures 25 on the side member 24 of the mounting plate 20 are circular, and similarly, the apertures 35 on the side flanges 34 of the intermediate plate 30 and the apertures 45 on the side members 46 of the top plate are elongated. This configuration, though opposite of that found in the preferred embodiment, will still provide a slideable connection between the mounting plate 20 and the intermediate plate 30 to allow the intermediate plate 30 to slide from front to rear relative to the mounting plate 20. However, this embodiment will not allow the pins to slide with the intermediate plate 30 and top plate 40, rather the pins 60 will remain stationary along with the mounting plate 20. Further, this embodiment is not compatible with the hook members 37 provided on the intermediate plate 30, and as such is not preferred for use with the hook members 37.

The top plate 40 is positioned over and encompasses the intermediate plate 30 and mounting plate 20. The top plate 40 comprises a body portion 42 having a front end, a rear end, and two sides. The body portion 42 further comprises a central aperture 49 aligned with the central aperture 38 of the intermediate plate 30 to allow access to the mounting screw engaged to the mounting plate 20. The body portion 42 is further provided with an elongated aperture 82 for receiving a cam screw 80 positioned off center proximate to one side of the body portion 42.

Depending from the front end of the body portion 42 is a front face 44 which extends downward to cover the intermediate plate 30 and mounting plate 20 and further provides a surface for slideably engaging the hinge arm 50. The front face 44 is further provided with a circular aperture 74 for receiving the cam screw 70. In a preferred embodiment of the present invention, the circular aperture 74 is flanked by two slots 48. The slots receive the legs 112 of a clip 110 which is employed to slideably retain the hinge arm 50. The clip 110 is positioned through the rear of the front face 44 and the legs 112 protrude through the slots 48 and engage the hinge arm 50. The legs 112 are designed with slight hooks on their distal end to grasp and engage the hinge arm 50. The hinge arm is then slideably engaged to the front face 44 as is know in the art.

Depending from the sides of the body portion 42 are side members 46. The side members are provided with circular apertures 45 for receiving the guide pin or pins 60. The side members 46 are spaced farther apart than the side members 24 of the mounting plate 20 such that the side members 46 of the top plate fit over and encompass the side members 24 of the mounting plate 20.

To illustrate the position of the various plates and pins in the assembled hinge assembly, FIG. 3 shows the underside of the hinge assembly. The pin 60 extends through a circular aperture 45 in one side member 46 of the L-shaped hinge arm segment 40, then through an elongated aperture 25 in one side member 24 of the mounting plate 20, then through one circular aperture 35 in the vertically extending portion 33 of the intermediate plate 30, across the intermediate plate through the hook member 37, then through the opposite circular aperture 35 in the intermediate plate 30, through the second elongated aperture 25 in the second side member 26 of the mounting plate 20, and finally through the second circular aperture 45 on the second side member 46 of the L-shaped hinge arm segment 40.

This configuration connects and engages the three plates such that they are slideable and adjustable relative to one another. The adjusting of the plates is accomplished through the cam screws 80 and 90. The side cam screw 80 extends through the elongated aperture 82 in the body portion 42 of the top plate 40. The elongated aperture is preferably located proximate to one side of the body portion and elongated in a direction parallel to the side. The off center rod of the cam screw 80 extends through the elongated aperture 82 and engages a circular aperture 84 provided in a horizontally extending portion 36 of the corresponding side flange 34 of the intermediate plate 30. The off center rod rotates within the circular aperture 84 causing the top of the cam screw to spin on an eccentric axis within the elongated aperture 82 which in turn causes the top plate 40 to move side to side relative to the intermediate plate 30.

Throughout this motion, the intermediate plate 30 remains stationary and engaged to the mounting plate 20. As the top plate moves from side to side, the hinge arm 50, hinge cup 10 and furniture door 2 are adjusted up and down relative to the furniture frame member 4. In this manner the position of the furniture door relative to the floor and furniture frame member may be adjusted by rotating the side cam screw 80. In a preferred embodiment of the present invention, the pins 60 will move along with the top plate 40 through the motion of the adjustment. The pins 60 will in turn slide from side to side relative to the intermediate plate 30 and the mounting plate 20.

The rear cam screw 90 extends through the elongated aperture 92 in the body portion 32 of the intermediate plate 30. The elongated aperture 92 is preferably located proximate to the rear of the body portion 32 and elongated in a direction parallel to the rear end. The off center rod of the cam screw 90 extends through the elongated aperture 92 and engages a circular aperture 94 provided toward the rear of the body portion 22 of the mounting plate 20. The off center rod rotates within the circular aperture 94 causing the top of the cam screw to spin on an eccentric axis within the elongated aperture 92 which in turn causes the intermediate plate 30 to move from front to rear relative to the mounting plate 20.

Throughout this motion, the top plate 40 remains stationary relative to the intermediate plate 30 and moves with the intermediate plate 30 relative to the mounting plate 20. The pins 60 engaged to the intermediate plate 30 and top plate 40 move with those plates from front to rear through the range of motion provided by the elongated apertures 25 in the side members 24 of the mounting plate 20. The pins 60 slide from the front to the rear of the elongated apertures 24 in the mounting plate 20, while remaining stationary in the circular apertures 35, 45 of the intermediate plate 30 and top plate 40, respectively.

Although the present invention has been described with reference to particular embodiments, it should be recognized that these embodiments are merely illustrative of the principles of the present invention. Those of ordinary skill in the art will appreciate that the apparatus and methods of the present invention may be constructed and implemented in other ways and embodiments. Accordingly, the description herein should not be read as limiting the present invention, as other embodiments also fall within the scope of the present invention.

What is claimed is:

1. A hinge assembly for mounting a door on a furniture frame for movement of the door between open and closed positions of the door relative to the furniture frame, the assembly comprising:

a mounting plate adapted to be affixed to a furniture frame member and having opposing upstanding side members with first and second elongate apertures formed in each of the opposing upstanding side members of the mounting plate an intermediate plate disposed atop of and slideably engaged to said mounting plate and having opposing vertically extending portions with first and second circular apertures formed in each of the opposing vertically extending portions of the intermediate plate a top plate disposed atop of and slideably engaged to said intermediate plate and said mounting plate and having opposing depending side members with first and second circular apertures formed in each of the opposing depending side members of the top plate a hinge arm slideably connected to said top plate; and, a first pin extending through the first apertures of each of the top plate, the intermediate plate, and the mounting plate, and a second pin extending parallel to the first pin through the second apertures of each of the top plate, the intermediate plate, and the mounting plate; and said intermediate plate is slideable relative to the mounting plate in a direction perpendicular to a longitudinal axis of the first and second pins, and the top plate is slideable relative to the intermediate plate in a direction parallel to the longitudinal axis of the first and second pins;

wherein said hinge assembly is adjustable such that the hinge arm can be adjusted in three dimensions relative to the mounting plate.

2. The hinge assembly of claim 1, wherein said top plate further comprises a body portion, a front face extending downward from said body portion, and said front face adapted to slideably engage said hinge arm.

3. The hinge assembly of claim 1, further comprising a side cam screw positioned proximate to one side of the top surface of the top plate and extending through an elongated aperture in said top surface, and through a circular aperture in the horizontally extending portion of the intermediate plate, such that by rotating the side cam screw an L-shaped hinge arm segment slides from side to side relative to the intermediate plate and the mounting plate, said pins moving with said top plate, thereby moving said furniture door up and down relative to said furniture frame.

4. The hinge assembly of claim 1, further comprising a rear cam screw positioned proximate a rear portion of the hinge assembly and extending through an elongated aperture in said rear portion of the intermediate plate and into a circular aperture in said rear portion of said mounting plate, such that by rotating the rear cam screw, the intermediate plate slides front to rear relative to the base plate, said pins and said top plate moving with said intermediate plate, thereby causing the furniture door to move in and out relative to the furniture frame.

5. The hinge assembly of claim 1, further comprising a hinge cup member adapted to be affixed to a door and pivotably connected to the hinge arm.

6. The hinge assembly of claim 5, further comprising a front cam screw extending through an elongated aperture on said hinge arm segment, and a circular aperture on the front face of said top plate, such that by rotating the front cam screw, the hinge arm slides up and down on a face of an L-shaped hinge arm segment thereby moving the hinge cup and furniture door from side to side relative to said furniture frame.

7. The hinge assembly of claim 1, wherein said mounting plate further comprises a body portion having an elongated mounting aperture, a front end, a rear end and two side ends.

8. The hinge assembly of claim 7, wherein said mounting plate further comprises a leg depending from said front end and said rear end in a direction opposite said side members, said legs positioned and aligned to engage and secure said mounting plate to said furniture frame.

9. The hinge assembly of claim 8, wherein said intermediate plate further comprises a hook member extending from said body portion for slideably engaging one of said pins between the two side flanges.

* * * * *